US005995634A

United States Patent [19]

Zwolski

[11] Patent Number: 5,995,634

[45] Date of Patent: Nov. 30, 1999

[54] SPEAKER AND LAMP COMBINATION

[76] Inventor: Scott A. Zwolski, 755 Falmore Dr., Bartlett, Ill. 60103

[21] Appl. No.: 09/086,009

[22] Filed: May 27, 1998

Related U.S. Application Data

[63] Continuation-in-part of application No. 08/867,325, Jun. 2, 1997, abandoned.

[51] Int. Cl.[6] ..... H04R 25/00

[52] U.S. Cl. ..... 381/160; 381/182; 381/388; 181/155

[58] Field of Search ..... 381/160, 337, 381/339, 352, 87, 388, 301, 333, 398, 182, 186, 89; 181/155, 199, 148, 153, 145, 144, 147; 362/89

[56] References Cited

U.S. PATENT DOCUMENTS

| | | | |
|---|---|---|---|
| 3,326,321 | 6/1967 | Valuch | 181/144 |
| 3,816,672 | 6/1974 | Gefvert et al. | 381/352 |
| 4,348,549 | 9/1982 | Berlant | 381/99 |
| 4,434,507 | 2/1984 | Thomas | 381/77 |
| 5,673,329 | 9/1997 | Wiener | 381/89 |
| 5,721,401 | 2/1998 | Sim | 181/148 |

*Primary Examiner*—Huyen Le
*Attorney, Agent, or Firm*—Charles F. Meroni, Jr.; Meroni & Meroni

[57] ABSTRACT

Attractive furniture which encloses a speaker system for improved functionality of both the furniture and speaker system. The furniture is hollow and can be lamps, tables or other pieces, allowing placement of a speaker system unobtrusively and attractively within a room. The speakers are arranged vertically within the hollow furniture, emitting sound vertically upwards and or downwards. Sound directing devices having parabolic surfaces are placed adjacent the speakers to redirect the sound horizontally over a 360 degree range. The furniture may enclose a single speaker and sound directing device or multiples of the same so as to achieve the desired sound output and aesthetic appearance.

18 Claims, 4 Drawing Sheets

SPEAKER AND LAMP COMBINATION

This application is a Continuation In Part of a previous application having Ser. No. 08/867,325 filed Jun. 2, 1997, now abandoned.

BACKGROUND OF THE INVENTION

The present invention relates generally to speakers for providing audio output for sound systems. More particularly, this invention relates to an apparatus for providing omni-directional sound and for incorporating the speakers into unique furniture designs.

Prior speaker systems have traditionally been directional and are located along one or more walls of a room. Typical speakers are box-like and often detract from the décor of a room due to their utilitarian appearance. Furthermore, speakers occupy a large volume of space in rooms where space is often limited. Previous attempts to incorporate speakers into furniture or lighting means have met with limited success.

U.S. Pat. No. 5,163,747 to Cheng discloses a hollow spherical desk lamp which houses a speaker. In this disclosure, the speaker is oriented vertically upward and emits sound from an opening in an upper aspect of the sphere. Cheng does not disclose multiple speakers or venting means.

U.S. Pat. No. 4,433,363 to Weber discloses multiple speakers housed within a chandelier for suspension from the ceiling of a room. Weber combines a speaker system within a chandelier for the purpose of centralizing the controls for devices in a single location. The speakers are located in the arms of the chandelier and emit sound horizontally. Weber uses a series of speakers arranged about the chandelier to accomplish a 360 degree range of sound emission.

U.S. Pat. No. 4,348,549 to Berlant discloses a loudspeaker system for providing sound output throughout a 360 degree range which is housed in a rectangular cabinet having four triangular vertical corner vents. Berlant further discloses a pair of speakers mounted within the cabinet along a vertical axis and uses a sound reflection device to redirect the emitted sound to a horizontal direction. However, the patent to Berlant is directed to a loudspeaker system and does not consider placement of the system within a hollow furniture item. The current invention, in contrast, is directed to an attractive piece of furniture which has increased functionality due to its combination with a speaker. The current invention also provides a novel venting means designed to enhance its aesthetic appearance.

SUMMARY OF THE INVENTION

The inventive apparatus is an attractive piece of furniture which houses one or more speakers configured to emit sound omni-directionally. Typically, the inventive furniture is cylindrical in shape and the speakers are mounted within the furniture in a vertical orientation. In this configuration, sound is emitted from the furniture upward from the top of the cylinder and downward from the bottom of the cylinder. Sound reflectors are placed in front of each speaker and are shaped to redirect the sound in a horizontal direction over 360 degrees.

Accordingly, it is the object of the present invention to provide attractive furniture which effectively incorporates omni-directional speakers. This is accomplished by mounting one or more speakers in selected furniture, such as a table, and providing a reflector in front of each speaker to redirect the sound.

It is an object of the present invention to provide attractive furniture which has increased functionality by virtue of the inclusion of a sound system.

It is an object of the present invention to provide an attractive furniture and speaker combination which is sized to allow easy placement of a sound system where a usual sound system would not be appropriate such as on or in end tables, night stands, and so forth.

It is an object of the present invention to provide a sound reflector which is designed to enhance the beauty of the furniture, to act as a support structure for the main cabinet and lamp fixture above, and to disburse sound in a horizontal plane throughout a 360 degree arc.

It is an object of the present invention to provide an attractive furniture and speaker combination in which the speaker found in the upper opening of the main cabinet is mounted is a spaced fashion from the main cabinet to provide a vent into the main cabinet. This vent allows air movement to enhance the low frequency response of the main driver. By mounting this way, the attractive aesthetic appearance of the cabinet is maintained since the speaker conceals the vent from view.

It is an object of the present invention to provide an attractive furniture and speaker combination which provides multiple speaker chambers within a single cabinet, and providing each chamber with a different speaker system, so that the single cabinet can provide multiple speaker systems as typically found in a surround sound system.

DETAILED DESCRIPTION

Figure 1:
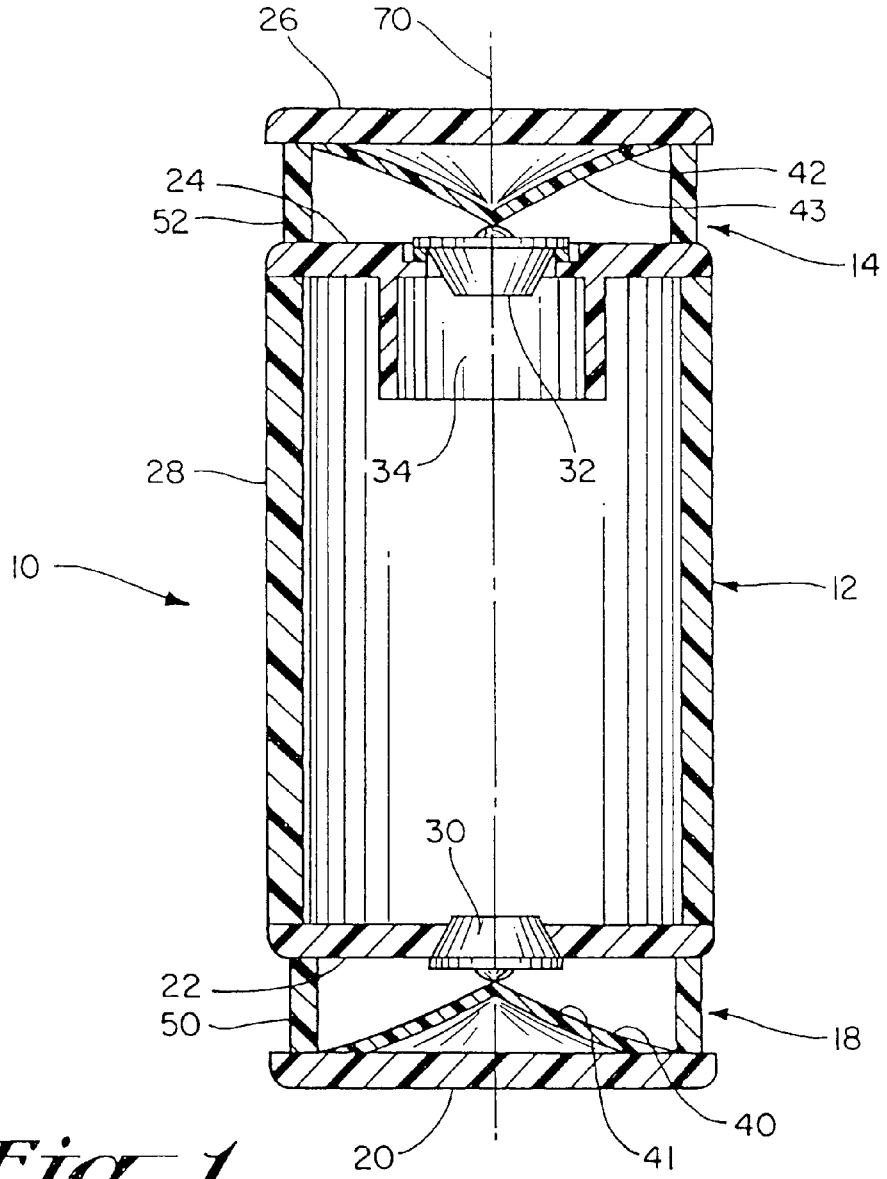
FIG. 1 is a sectional view of the invention showing the speakers mounted along a vertical axis and the positioning of the sound reflectors relative to the speakers.

The inventive device consists of a hollow furniture piece which encloses a speaker system. In FIG. 1, a hollow furniture cabinet 10 is shown in section. In the preferred embodiment, cabinet 10 is generally cylindrical. However, the inventive concept extends to the cabinet having cross sections other than circular, such as polygonal, as long as the cross section is closed to form a tube. Cabinet 10 has a longitudinal axis 70 which extends vertically, a top 24, and bottom 22. Cabinet 10 has a base member 12 which provides the main body of the device, and also has a lower member 18 below the base member 12. Cabinet 10 further has an upper member 14 above base member 12.

Base member speakers 30 and 32 are mounted in a spaced relationship along the longitudinal axis 70. Upper speaker 32 is mounted so as to emit sound vertically upward toward the top 24 of the cabinet 10. Lower speaker 30 is mounted so as to emit sound vertically downward toward the bottom 22 of the cabinet 10. Cone-shaped sound reflectors 40, 42 are placed directly in front of and in vertical alignment with each of the speakers 30, 32, respectively. The sound reflectors 40, 42 are maintained in a spaced relationship from the speakers 30, 32 by means of lower column supports 50 at the lower end of the base member 12, and by means of upper column supports 52 at the upper end of base member 12.

In the preferred embodiment, column supports 50, 52 are elongate cylinders in shape and are evenly spaced adjacent the perimeter of the top 24 and bottom 22, respectively, of base member 12. In the preferred embodiment, four columns are used to support each sound reflector 40, 42. However, it is within the scope of the invention that the column may take on any shape and cross section, and that the number of columns used may increase or decrease depending on the functional and aesthetic needs of the particular application. Employment of support columns provides large open spaces which allow the sound to emerge from the cabinet unattenuated.

Sound reflectors 40, 42, have two opposed surfaces. The first surfaces 41 and 43, respectively, are generally cone-like as described above and are directed such that the apex of the cone is aligned with and adjacent to the speaker and the axis of the cone coincides with the longitudinal axis 70 of the base member 12. In the preferred embodiment, the surfaces 41, 43 are parabolic. Placement of the first surfaces 41, 43 in front of the speakers 30, 32 redirects the emitted sound from the vertical to the horizontal and also spreads it throughout a 360 degree arc. It is within the scope of this invention to use an alternative shape for the reflecting surface as long as the alternative shape provides means for redirecting the emitted sound from an axial direction to a direction which is 90 degrees from the axial direction, and also provides for directing the sound over a 360 degree range.

Figure 5:
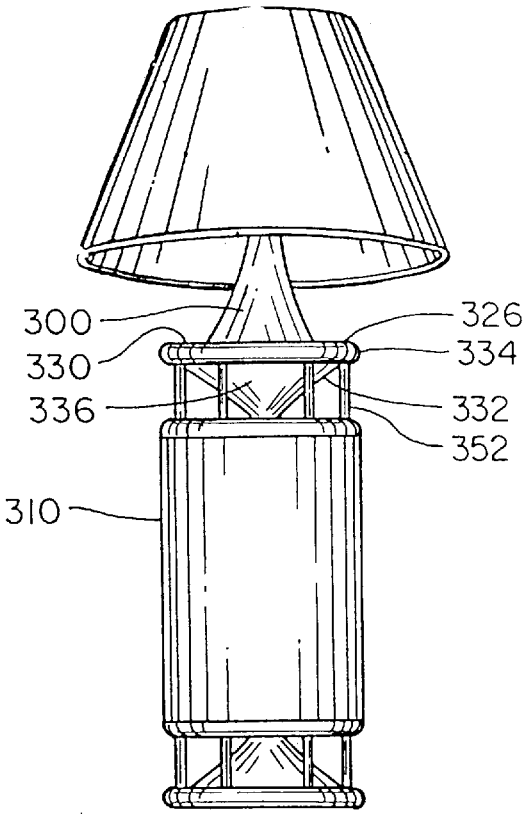
FIG. 5 is a side view of one embodiment employing the concept of this invention.

The second or opposing surfaces, 20 and 26, respectively, of the sound reflectors 40, 42 are flat and provide a base for support. In the preferred embodiment, surface 26 forms a base for supporting a lamp structure as shown in FIG. 5. In all embodiments, surface 20 provides the base for supporting the entire furniture piece and would typically rest on the floor or table top.

Figure 2:
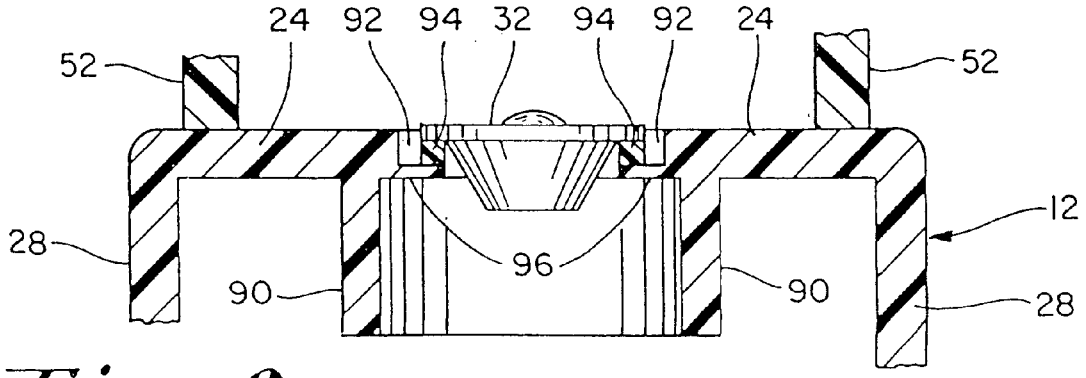
FIG. 2 is an enlarged partial sectional view of the upper portion of the main cabinet showing the mounting of the speaker in a spaced relationship from the cabinet to provide a vent.

Speakers 30 and 32 are mounted within base member 12 such that they lie within openings formed in the top 24 and bottom 22. Referring now to FIG. 2, the opening in the top 24 of base member 12 is formed with a ledge portion 96 extending therefrom. Speaker 32 is mounted in this opening in a spaced apart relationship from ledge portion 96. Spacers 94 are used intermittently along the periphery of speaker 32, between speaker 32 and a ledge portion 96, lifting speaker 32 up away from the top 24 to form an air vent 92 between the interior of the base member 12 and the exterior. The air vent 92 allows air movement between the interior and exterior spaces to enhance the low frequency response of the main driver, speaker 30. It should be noted that speaker 30 is mounted within the opening in the bottom 22 such that it lies flush with the opening and does not provide an air vent in the bottom portion of the cabinet 10.

The speakers 30, 32, and sound reflectors 40, 42 can be adjusted both in size and frequency response to achieve desired visual and acoustical effects. These changes can also be enhanced by variations in the shape and volume of the cabinet 10. All speakers are electronically connected to a sound system in accordance with methods well known in the art.

Figure 3:
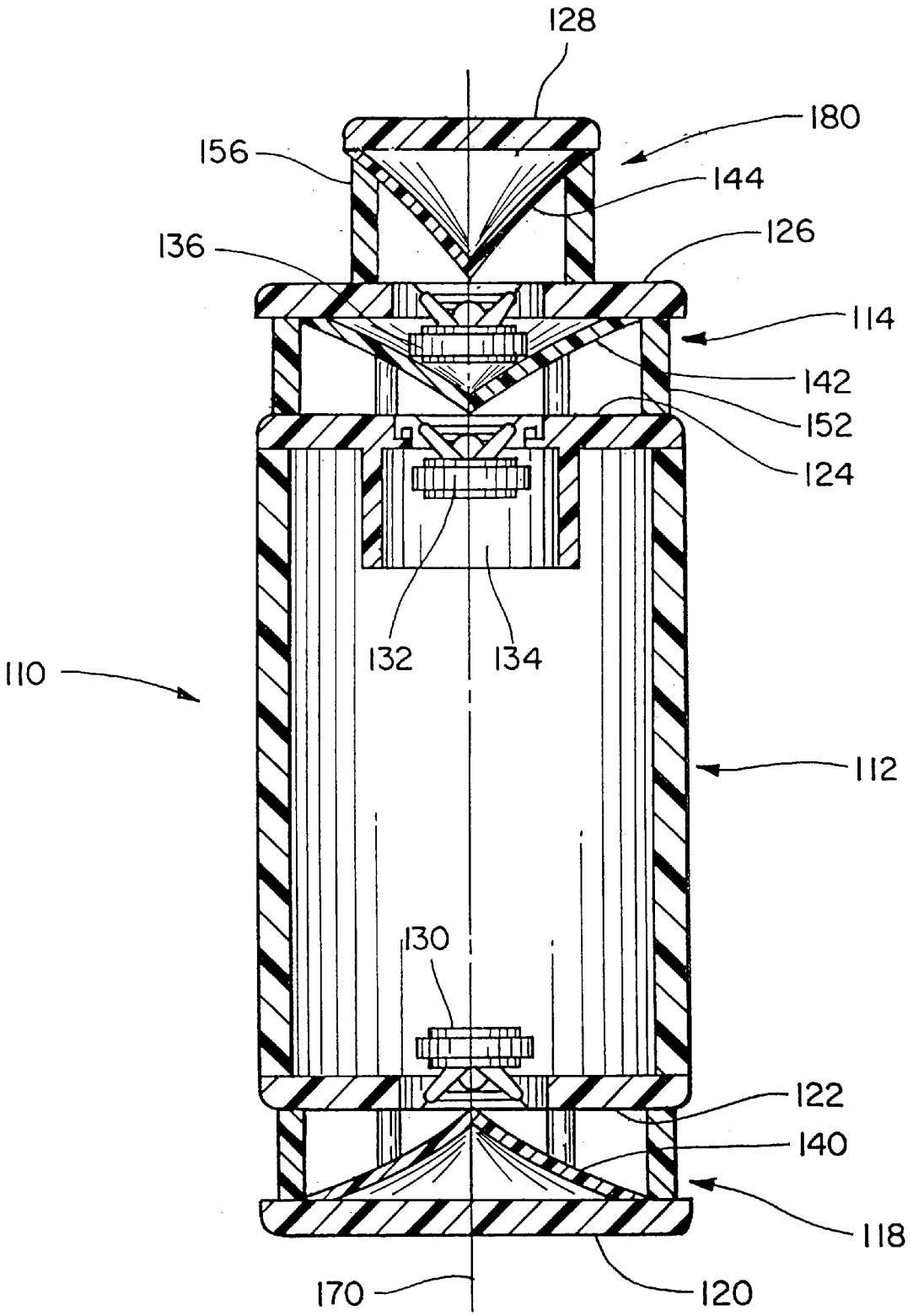
FIG. 3 is a sectional view of a second embodiment showing a third speaker mounted above the cabinet.

Additional speaker/reflector combinations can be provided on the system to improve performance. FIG. 3 shows a second embodiment of the furniture and speaker combination employing 3 speakers. Hollow cabinet 110 is comprised of base member 112, upper member 114, and lower member 118 which enclose speakers 130, 132 and sound reflectors 140, 142 as described in the first embodiment. Cabinet 110 is further comprised of a second upper member 180 which is mounted to surface 126 of the upper sound reflector 142. Second upper member 180 provides the structure for mounting an additional speaker to the upper member 114 of the cabinet 110. In this embodiment, a third speaker 136 is mounted within an opening in surface 126 such that it lies within the sound reflector 142. A third sound reflector 144 is mounted adjacent speaker 136 and is supported in a spaced relationship to speaker 136 by column supports 156. Sound reflector 144 has a second or opposed surface 128 which is flat and provides a base for support.

The embodiment of FIG. 3 discloses a sound system having a base member 112 with a single lower member 118 and two upper members 114 and 180. In this embodiment, lower speaker 130 is a woofer, speaker 132 provides a midrange output, and speaker 136 is a tweeter. However, it is within the scope of this invention that the base member 112 can have any combination of single or multiple upper and lower members, and further within the scope of the invention that any speaker can be selected, whereby the furniture and speaker combination will achieve the desired output performance and aesthetic appearance.

Figure 4:
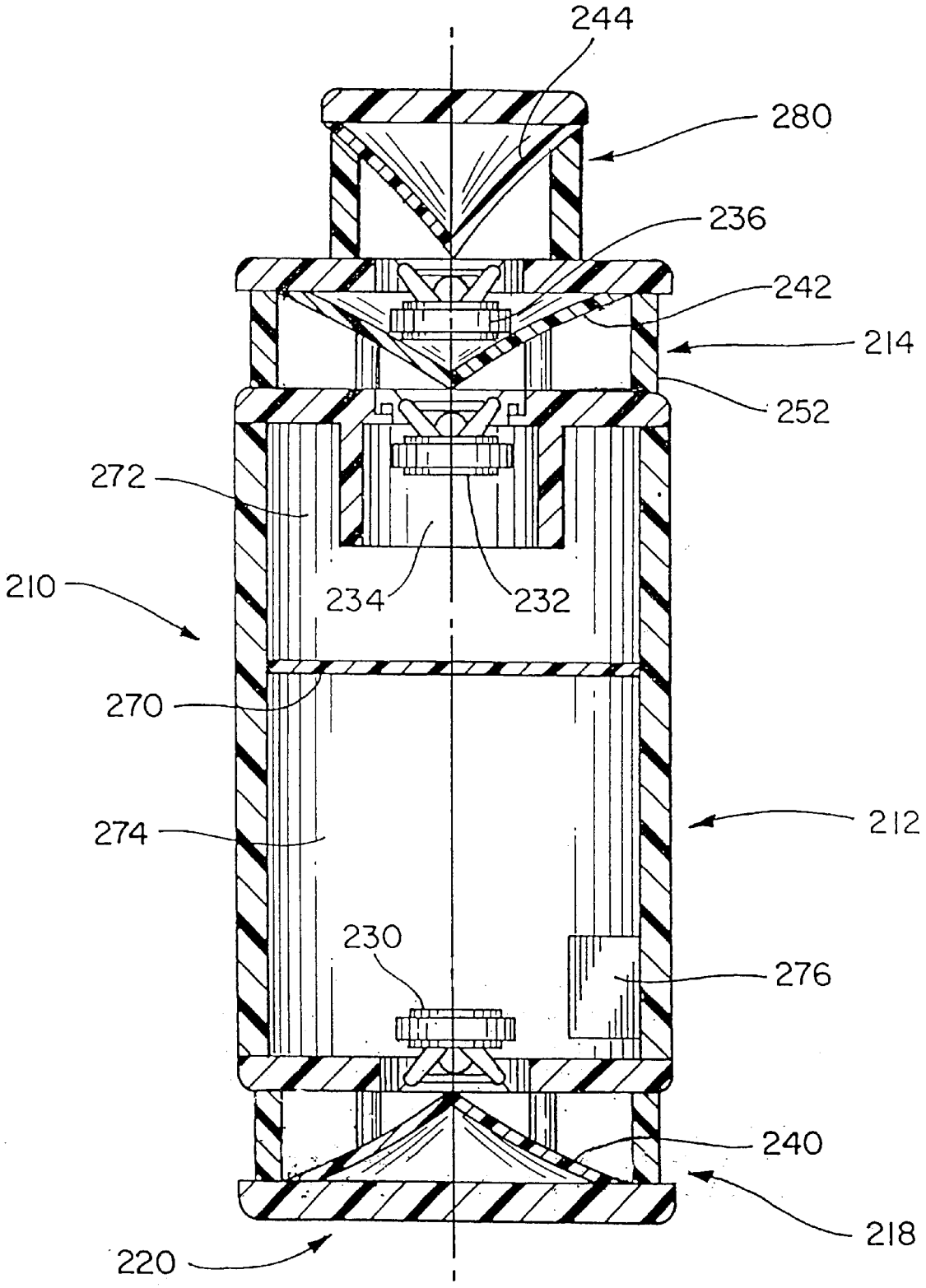
FIG. 4 is a sectional view of a third embodiment showing a large floor standing unit designed for use in a surround sound speaker system where the cabinet is divided into compartments to provide multiple speaker systems within one piece of furniture.

Referring now to FIG. 4, a third embodiment of the invention is directed for use with stereo surround sound systems which are included in many home entertainment systems. Hollow cabinet 210 is comprised of base member 212, upper member 214, second upper member 280, and lower member 218 which enclose speakers 230, 232, and 236 and sound reflectors 240, 242 and 244 as described in the second embodiment.

In the third embodiment, base member 212 will be separated into two separate compartments, upper compartment 272 and lower compartment 274, by means of a horizontal divider 270.

Lower speaker 230, housed within lower compartment 274, will be a subwoofer (20–80 Hz) powered by amplifier 276 and will be driven independently of the upper speakers 232, 236.

Speaker 232, housed within upper compartment 272, will be a woofer (greater than 40 Hz). Speaker 232 differs from speakers 32 and 132 of the first and second embodiments, respectively, in that it is not mounted in a spaced relationship from the cabinet 210. This change results from the compartmentalizing of the cabinet 210. Speaker 232 will be driven together with speaker 236 and is intended to be used as the front or rear speakers typically used in surround sound systems. Speaker 236, mounted above speaker 232, will act as a tweeter ( up to 20 kHz). Speakers 232 and 236 will act as a separate sound system from lower speaker 230.

Speakers 232, 236 will provide a full range of sound, comparable to the center channel speakers in a surround sound system, and emit sound from the upper end of cabinet 210. The powered subwoofer speaker 230 will provide only low frequency signals which will be emitted from the lower end of the cabinet. Thus this embodiment is a system which provides two speaker systems in one cabinet.

The compartments 272, 274 are sized according to the size of speaker selected for use within the compartment and according to the frequency output required. Compartment 274 houses a relatively large speaker 230 and is required to achieve a very low frequency output, and thus is proportionately large compared to compartment 272.

Figure 6:
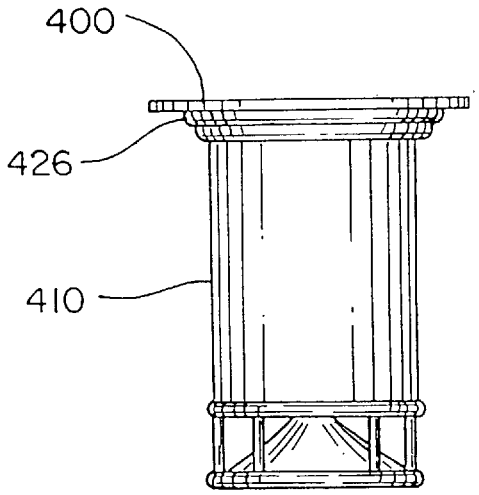
FIG. 6 is a side view of another embodiment employing the concept of this invention.
Figure 7:
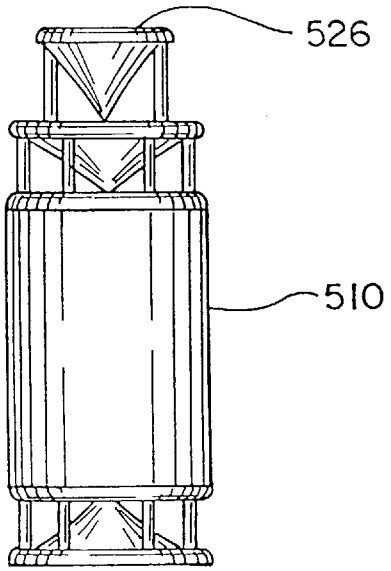
FIG. 7 is a side view of yet another embodiment employing the concept of this invention.

The cabinets 10, 110, and 210 each provide a means by which a speaker system can be incorporated into attractive furniture. FIG. 5 is a lamp in combination with the two-speaker system of the first embodiment. The lamp device 300 is mounted to the top 326 of cabinet 310. Top 326 forms a platform which supports the lamp, and is maintained in a spaced relationship with cabinet 310 by at least three cylindrical posts 352. This platform has first and second sides which are opposed. The first side 330 is the upper, flat surface to which is mounted the lamp. The second side 332 is the shaped surface, the shaped surface having a disk shaped base portion 334 and a center portion 336 which extends from the perimeter of the base portion 334 in a smooth continuous curve which terminates in a sharp, pointed, concentric apex. FIG. 6 depicts a table in combination with a single speaker system wherein sound is emitted from the lower portion of the table. In this embodiment, table top 400 is mounted to the top 426 of cabinet 410. FIG. 7 is a large floor standing speaker system in cabinet 510, and includes a lower speaker and two upper speakers. The floor standing speaker system is an attractive furniture piece as is, or can be modified to a floor lamp by mounting a lamp device to the top 526.

From the foregoing description, it will be apparent that modifications can be made to the apparatus without departing from the teachings of the present invention. Accordingly, the scope of the invention is only to be limited as necessitated by the accompanying claims.

I claim:

1. A combination article of furniture and speaker system comprising a article of furniture and a speaker system housed within said article of furniture, said piece of furniture comprising a base member, said base member being tubular and having a closed cross section, a top, a bottom, a central axis which is oriented vertically, an interior and an exterior, said base member having a first opening in said bottom wherein said first opening is centered on said central axis, said speaker system comprising at least one speaker, wherein said speaker is mounted within said first opening such that it is centered on said central axis and positioned facing exteriorly so as to emit sound in the direction of the central axis, said speaker system further comprising a sound directing device, wherein said sound directing device is comprised of a surface having a parabolic shape, said parabolic shape having an apex and a base, said sound directing device being mounted such that the apex is aligned with the central axis and adjacent said speaker to redirect sound emitted from the speaker from a vertical direction to a horizontal direction, wherein said base member has a second opening in said top, wherein said second opening is centered on said central axis, and wherein said speaker system is comprised of a second speaker wherein said second speaker is mounted within said second opening such that it is centered on said central axis and positioned facing exteriorly so as to emit sound in the direction of the central axis, and further wherein said second opening has a ledge portion extending therefrom, and wherein said second speaker is attached to said ledge portion such that it is maintained lifted above said ledge in a spaced apart relationship to said ledge using mounting means, wherein said mounting means comprises a plurality of spacers placed between said ledge and said speaker, and wherein a second sound directing device which is comprised of a surface having a parabolic shape, said parabolic shape having an apex and a base, said second sound directing device being mounted adjacent said second speaker such that the apex is aligned with the central axis and lies adjacent said second speaker to redirect sound emitted from the second speaker from a vertical direction to a horizontal direction.

2. The combination of claim 1 wherein the second sound directing device is mounted to the top of said base member, said second sound directing device having a flat surface opposed to its parabolic surface, said flat surface having an opening therein, and wherein the speaker system is comprised of a third speaker, said third speaker being housed within said opening within said flat surface of the second sound directing device.

3. The combination of claim 2 wherein the flat surface of the second sound directing device provides a mounting base for a third sound directing device, said third sound directing device is comprised of a surface having a parabolic shape, said parabolic shape having an apex and a base, said third sound directing device being mounted adjacent said third speaker such that the apex is aligned with the central axis and lies adjacent said third speaker to redirect sound emitted from the third speaker from a vertical direction to a horizontal direction.

4. The combination of claim 3 further comprising a lamp device affixed to said top.

5. A combination furniture and speaker system comprising a piece of furniture and a speaker system housed within said piece of furniture, said combination comprising a base member, said base member being tubular and having a closed cross section, a top, a bottom, a central axis which is oriented vertically, an interior and an exterior, said base member having a first opening in said bottom wherein said first opening is centered on said central axis, and having a second opening in said top wherein said second opening is centered on said central axis, said speaker system comprising at least one speaker, wherein a first speaker is mounted within said first opening such that it is centered on said central axis and positioned facing downward exteriorly so as to emit sound in the direction of the central axis, wherein a second speaker is mounted within said second opening such that it is centered on said central axis and positioned facing upward exteriorly so as to emit sound in the direction of the central axis, said speaker system further comprising at least one sound directing device, wherein said sound directing device is comprised of a surface having a parabolic shape, said parabolic shape having an apex and a base, a first and second sound directing device being mounted adjacent each of said first and second speakers, respectively, such that the apexes are aligned with the central axis and lie adjacent said speakers to redirect sound emitted from the speakers from a vertical direction to a horizontal direction, and wherein the second sound directing device is mounted to the top of said base member, said second sound directing device having a flat surface opposed to its parabolic surface, said flat surface having an opening therein, and a third speaker being housed within said opening wit said flat surface of the second sound directing device, and wherein the flat surface of the second sound directing device provides a mounting base for a third sound directing device, said third sound directing device being mounted adjacent said third speaker such that the apex is aligned with the central axis and lies adjacent said third speaker to redirect sound emitted from the third speaker from a vertical direction to a horizontal direction, and wherein the base member is further comprised of a horizontal dividing wall within its interior, said dividing wall forming a first upper compartment and a second lower compartment, said first upper compartment enclosing said second speaker, said second lower compartment enclosing said first speaker, and wherein said second lower compartment is much larger than said first upper compartment.

6. The combination of claim 5 further comprising a lamp device affixed to said top.

7. An attractive article of furniture, said article of furniture comprising a cabinet portion, a lamp portion, and a speaker system portion, wherein the cabinet portion is comprised of an elongate hollow tubular chamber having a longitudinal axis which is oriented vertically, said chamber having a top end and a bottom end, and wherein the speaker system portion is mounted within said cabinet portion such that sound is emitted externally of the cabinet portion and in a direction which is parallel with the longitudinal axis, and wherein the lamp portion is mounted to the top end of said chamber using lamp mounting means, and wherein the lamp mounting means is comprised of at least three cylindrical posts which maintain the lamp portion in a spaced relationship to said chamber, and wherein said lamp mounting means is comprised of a first platform having first and second sides which are opposed, said second side comprising a first shaped surface, wherein the lamp mounting means is oriented relative to said chamber such that the second side lies adjacent to said speaker system portion, wherein said first shaped surface is comprised of disk shaped base portion and of a center portion that extends from the perimeter of the base portion in a smooth continuous curve which terminates in a sharp, pointed, concentric apex, and wherein said shaped surface redirects the sound emitted from said speaker system portion from a vertical direction to a horizontal direction, and further wherein the redirected sound is directed throughout 360 degrees in the horizontal direction.

8. The article of furniture of claim 7 wherein said top end and said bottom end have openings therein which are sized to receive speakers, and wherein the speaker system portion is comprised of at least two speakers, said two speakers comprising an upper speaker and a lower speaker, wherein said lower speaker is mounted in said opening in said bottom end so that said lower speaker completely fills said opening in said bottom and lies in a close nonspaced relationship to said opening in said bottom, and wherein said upper speaker has an upper portion and a lower portion, and said upper speaker is mounted in said opening in said top end so that the upper portion of the upper speaker lies suspended above said opening in a spaced relationship to said opening and so that said lower portion of said upper speaker extends into said opening in said top end.

9. The article of furniture of claim 8 further comprising a second shaped surface which is identical in shape to the first shaped surface, said second shaped surface being mounted to said bottom end in a spaced apart relationship therefrom, and being mounted so that the apex of said second shaped surface lies adjacent to said lower speaker and so that the disk shaped base portion forms a base of support for the article of furniture and wherein said second shaped surface is maintained relative to said bottom end by means of at least three cylindrical posts.

10. The article of furniture of claim 9 wherein said first and second shaped surfaces are parabolic.

11. The article of furniture of claim 10 wherein the speaker system portion is comprised of a third speaker, and wherein the disk shaped base portion of said first shaped surface has an opening therein, and wherein said third speaker is received within said opening in said disk shaped base portion, and wherein said lamp mounting means is comprised of a second platform having first and second sides which are opposed, said second side comprising a third shaped surface which is identical in shape to the first shaped surface but being smaller in size, wherein said second platform is oriented relative to said third speaker such that the second side lies adjacent to said third speaker, and wherein said first side of said second platform has means for supporting a light source.

12. A combination furniture and speaker system comprising a piece of furniture and a speaker system housed within said piece of furniture, said combination comprising a base member, said base member being tubular and having a closed cross section, a top, a bottom, a central axis which is oriented vertically, an interior and an exterior, said base member having a first opening in said bottom wherein said first opening is centered on said central axis, said speaker system comprising at least one speaker, wherein said speaker is mounted within said first opening such that it is centered on said central axis and positioned facing exteriorly so as to emit sound in the direction of the central axis, said speaker system further comprising a sound directing device, wherein said sound directing device is comprised of a surface having a parabolic shape, said parabolic shape having an apex and a base, said sound directing device being mounted such that the apex is aligned with the central axis and lies adjacent said speaker to redirect sound emitted from the speaker from a vertical direction to a horizontal direction, and wherein said base member has a second opening in said top, wherein said second opening is centered on said central axis, and wherein said speaker system is comprised of a second speaker wherein said second speaker is mounted within said second opening such that it is centered on said central axis and positioned facing exteriorly so as to emit sound in the direction of the central axis, and farther wherein said second opening has a ledge portion extending therefrom, and wherein said second speaker is attached to said ledge portion such that it is maintained lifted above said ledge in a spaced apart relationship to said ledge using mounting means, wherein said mounting means comprises a plurality of spacers placed between said ledge and said speaker.

13. The combination of claim 12 further comprising a lamp device affixed to said top.

14. The combination of claim 12 wherein said speaker system is comprised of a second sound directing device which is comprised of a surface having a parabolic shape, said parabolic shape having an apex and a base, said second sound directing device being mounted adjacent said second speaker such that the apex is aligned with the central axis and lies adjacent said second speaker to redirect sound emitted from the second speaker from a vertical direction to a horizontal direction.

15. An attractive article of furniture, said article of furniture comprising a cabinet portion, a lamp portion, and a speaker system portion, wherein the cabinet portion is comprised of an elongate hollow tubular chamber having a longitudinal axis which is oriented vertically, said chamber having a top end and a bottom end, and wherein the speaker system portion is mounted within said cabinet portion such that sound is emitted externally of the cabinet portion and in a direction which is parallel with the longitudinal axis, and wherein the lamp portion is mounted to the top end of said chamber using lamp mounting means, and wherein the lamp mounting means is comprised of at least three cylindrical posts which maintain the lamp portion in a spaced relationship to said chamber, and wherein said lamp mounting means is comprised of a first platform having first and second sides which are opposed, said second side comprising a first shaped surface, wherein the lamp mounting means is oriented relative to said chamber such that the second side lies adjacent to said speaker system portion, wherein said first shaped surface is comprised of disk shaped base portion and of a center portion that extends from the perimeter of the base portion in a smooth continuous curve which terminates in a sharp, pointed, concentric apex, and wherein said shaped surface redirects the sound emitted from said speaker system portion from a vertical direction to a horizontal direction, and fisher wherein the redirected sound is directed throughout 360 degrees in the horizontal direction, and wherein said top end and said bottom cud have openings therein which are sized to receive speakers, and wherein the speaker system portion is comprised of at least two speakers, said two speakers comprising an upper speaker and a lower speaker, wherein said lower speaker is mounted in said opening in said bottom end so that said lower speaker completely fills said opening in said bottom and lies in a close non-spaced relationship to said opening in said bottom, and wherein said upper speaker has an upper portion and a lower portion, and said upper speaker is mounted in said opening in said top end so that the upper portion of the upper speaker lies suspended above said opening in a spaced relationship to said opening and so that said lower portion of said upper speaker extends into said opening in said top end.

16. The article of furniture of claim 15 further comprising a second shaped surface which is identical in shape to the first shaped surface, said second shaped surface being mounted to said bottom end in a spaced apart relationship therefrom, and being mounted so that the apex of said second shaped surface lies adjacent to said lower speaker and so that the disk shaped base portion forms a base of support for the article of furniture and wherein said second shaped surface is maintained relative to said bottom end by means of at least three cylindrical posts.

17. The article of furniture of claim 16 wherein said first and second shaped surfaces are parabolic.

18. The article of furniture of claim 17 wherein the speaker system portion is comprised of a third speaker, and wherein the disk shaped base portion of said first shaped surface has an opening therein, and wherein said third speaker is received within said opening in said disk shaped base portion, and wherein said lamp mounting means is comprised of a second platform having first and second sides which are opposed, said second side comprising a third shaped surface which is identical in shape to the first shaped surface but being smaller in size, wherein said second platform is oriented relative to said third speaker such that the second side lies adjacent to said third speaker, and wherein said first side of said second platform has means for supporting a light source.

* * * * *